US005346185A

United States Patent [19]

Sano et al.

[11] Patent Number: 5,346,185

[45] Date of Patent: Sep. 13, 1994

[54] VACUUM-SUCTION DEGASSING APPARATUS

[75] Inventors: Masamichi Sano, Nagoya; Nobuo Miyagawa; Kunji Yamamoto, both of Tajimi, all of Japan

[73] Assignees: Tokyo Yogyo Kabushiki Kaisha, Tokyo; Masamichi Sano, Nagoya, both of Japan

[21] Appl. No.: 73,660

[22] Filed: Jun. 8, 1993

Related U.S. Application Data

[63] Continuation of Ser. No. 998,631, Dec. 29, 1992, abandoned, which is a continuation of Ser. No. 715,637, Jun. 14, 1991, abandoned.

[30] Foreign Application Priority Data

Jun. 16, 1990 [JP] Japan ..... 2-158324

[51] Int. Cl.[5] ..... C21C 7/00

[52] U.S. Cl. ..... 266/208; 75/405

[58] Field of Search ..... 266/208, 239, 220; 75/405

[56] References Cited

U.S. PATENT DOCUMENTS 2,752,233 6/1956 Peyches ..... 75/10.15

4,836,508 6/1989 Fishler ..... 266/220

FOREIGN PATENT DOCUMENTS 0188038 12/1956 Fed. Rep. of Germany .

61-56257 3/1986 Japan .

0829777 3/1960 United Kingdom ..... 266/208

*Primary Examiner*—Scott Kastler

*Attorney, Agent, or Firm*—Oblon, Spivak, McClelland, Maier & Neustadt

[57] ABSTRACT

A melt is stored in a vessel, and a lower half portion of a rod-formed porous member is immersed in the melt. The porous member is made of a porous material having pores which is permeable to gas and impermeable to melts, such as molten metal, molten slag, and molten matte. When the vessel is placed in a decompression container and the portion of the porous member which protrudes above a surface of the melt is put in vacuum or under reduced pressure, gases in the melt or gases produced by reactions between components of the porous member and the melt pass through pores of the porous member and are released to vacuum or depressurized atmosphere in the decompression container. Thus, gas-forming components are removed from the melt.

10 Claims, 2 Drawing Sheets

VACUUM-SUCTION DEGASSING APPARATUS

This application is a continuation of application Ser. No. 07/998,631, filed on Dec. 29, 1992, now abandoned, which is a continuation of Ser. No. 07/715,637, filed Jun. 14, 1991, also abandoned.

BACKGROUND OF THE INVENTION

The present invention relates to a vacuum-suction degassing apparatus, in which gas-forming solute ingredients are removed or recovered from a melt, such as a molten metal, matte, or slag, through a porous member.

Conventionally, the RH method, DH method, and other degassing methods are used to remove gas-forming solute ingredients from a molten metal. According to the RH or DH method, a large quantity of argon gas is blown into the melt, the surface of which is kept at a vacuum or at reduced pressure so that the partial pressure of the gas-forming ingredients is lowered, thereby removing these ingredients.

Requiring the use of argon gas in large quantity, however, the conventional RH or DH degassing method entails high running cost. Since much argon gas is blown into the melt, moreover, the melt is liable to splash so that many metal drops adhere to the wall surface or some other parts of the apparatus, which requires troublesome removal work. To cope with this splashing of the melt, furthermore, the apparatus is inevitably increased in size, resulting in higher equipment cost.

SUMMARY OF THE INVENTION

The object of the present invention is to provide a vacuum-suction degassing apparatus, in which gas-forming ingredients can be easily removed from a melt without using a large quantity of argon gas, so that the melt can be degassed at low cost by means of a simple apparatus.

A vacuum-suction degassing apparatus according to the first invention, a vessel containing a melt; a porous member made of a porous material permeable to gas and impermeable to melts, a portion thereof being immersed in said melt in the vessel; and sucking means for sucking gas from said melt or gas produced by a reaction between said melt and said porous material through said partitioning member, in a manner such that the portion of said porous member which protrude over the surface of said melt is kept at a vacuum or at a reduced pressure.

A vacuum-suction degassing apparatus according to the second invention, a vessel containing a melt; a cylindrical non-porous member; a porous member made of a porous material permeable to gas and impermeable to melts, being fitted into the lower portion of said non-porous member and immersed in said melt in said vessel; and sucking means for sucking gas from said melt or gas produced by a reaction between said melt and said porous material through said partitioning member, in a manner such that the inside of said non-porous member is kept at a vacuum or at a reduced pressure. The partitioning member is sucked by said sucking means, thereby the inside of the partitioning member being kept at a vacuum or at reduced pressure. Also, the melt is stirred by moving said partitioning member in said melt by said stirring means so that gas in the melt or gas produced by the reaction between the melt and the porous member can be moved to vacuum or reduced pressure space inside the partitioning member through said partitioning member made of a porous material with high efficiency. Also, the vacuum suction degassing apparatus according to the present invention does not have to use argon gas, so that its running cost is low and also it is possible to suppress generation of splashes and reduce deposition of base metal onto a wall surface of the apparatus. Thus, according to the present invention, it is possible to reduce the equipment cost as well as its running cost.

According to the first invention, a portion of a porous member made of a porous material which allows permeation of gases but does not allow permeation of molten materials is immersed in a melt, and another portion of said porous member which protrudes above the surface of melt is put in vacuum or under reduced pressure. Gases of said melt or gases produced by reactions between said melt and said porous material are sucked through said porous member by sucking means.

According to the second invention, a porous member is fitted into the lower portion of a cylindrical non-porous member and the porous member is immersed in said melt. Inside of said non-porous member is evacuated or depressurized, and gases in said melt or gases produced by reactions between said melt and said porous material are sucked through said porous member by sucking means.

Thus, solute components in the melt, which produce a gas phase, can easily be moved to the vacuum or reduced pressure atmosphere.

Different from the conventional degassing method where a large volume of argon gas is blown into, in this invention, argon gas is not blown into, or a small volume of argon gas only enough to stir the melt is blown, so that an amount of argon gas used can remarkably be reduced. Also, as the amount of argon gas is extremely low, generation of splashes is suppressed, and deposition of base metal on a wall surface of a device can be reduced. For this reason, according to the present invention, equipment cost can be reduced by minimizing size of the apparatus, and also running cost can remarkably be reduced.

DETAILED DESCRIPTION OF THE PREFERRED EMBODIMENTS

Figure 1:
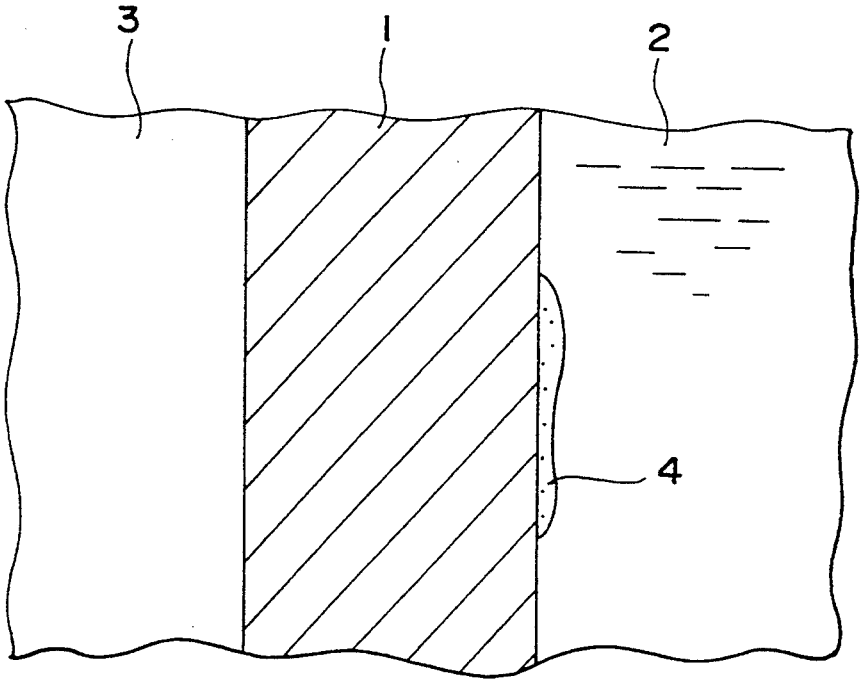
FIG. 1 is a diagram for illustrating the principle of the present invention.

First, description is made for a principle of this invention with reference to FIG. 1. Partitioning member 1 is made of a porous material which is permeable to gas, but impermeable to melts, such as molten metal, molten matte, or molten slag. If melt 2 is brought into contact with one side of porous member 1, and if the other side of member 1 is kept at a vacuum or at a reduced pressure 3, the pressure on the wall surface in contact with the melt drops without regard to the static pressure of melt 2.

Accordingly, those impurities or valuables in melt 2 which produce gaseous substances easily nucleate on the wall surface of porous member 1 to form gas 4, and resulting gas 4 permeates through member 1 and sucked into space 3 at vacuum or reduced pressure atmosphere so that the impurities or valuables are removed from the melt and recovered into space 3 at vacuum or reduced pressure atmosphere.

The inventor hereof realized that gas-forming ingredients can be removed from the melt on the basis of the principle described above, and brought the present invention to completion.

The gas-forming ingredients dissolved in the melt are sucked and removed in the form of gases as follows:

$$\underline{N}+\underline{N}=N_2 \quad (1)$$

$$\underline{H}+\underline{H}=H_2 \quad (2)$$

$$\underline{C}+\underline{O}=CO \quad (3)$$

$$\underline{S}+2\underline{O}=SO_2 \quad (4)$$

The impurities in the melt may react with the ingredients of the porous member, to form gases, and then they may be removed through the porous member.

If the porous member is an oxide ($M_XO_Y$), carbon in the melt is removed in the form of a gas as follows:

$$y\underline{C}+M_XO_Y\,(\text{solid})=x\underline{M}+yCO \quad (5)$$

If the porous member contains carbon, moreover, oxygen in the melt is sucked and removed according to the following reaction formula.

$$\underline{O}+C\,(\text{solid})=CO \quad (6)$$

The separative recovery of a valuable component (M) which has high vapor pressure is achieved by gasifying the valuable component according to the following reaction formulas.

$$x\underline{M}=M_X\,(\text{gas}) \quad (7)$$

$$MO_Y=MO_Y\,(\text{gas}) \quad (8)$$

$$MS_Y=MS_Y\,(\text{gas}) \quad (9)$$

In this manner, the impurities, such as N, H, C, O, and S, and the valuable components are sucked and removed or recovered from the melt.

According to the present invention, by adjusting content of components of the partitioning member which react with the impurities or valuable components in a melt, it is possible to control a reaction rate between the impurities or valuable components in the melt and components of the partitioning member.

Note that a heating means may be added to heat a porous member or a melt by energizing the porous member or burying a resistance wire previously in the porous member and energizing the resistance wire, or by heating the melt from outside (by means of, for instance, plasma heating), for the purpose to prevent the decrease of temperature of the melt due to heat emission to atmosphere or the vessel or the decrease of temperature of the melt which occurs when the porous member is immersed into the melt, or decrease of temperature of the melt due to an endothermic reaction between components of the porous member and the melt.

Various materials may be used for porous member, including metal oxides or other metallic compounds (non-oxides), carbon and mixtures thereof and metal, such as $Al_2O_3$, MgO, CaO, $SiO_2$, $Fe_2O_3$, $Fe_3O_4$, $Cr_2O_3$, BN, $Si_3N_4$, SiC, C, etc.. Preferably, the material used should not react with the principal ingredient of melt 2 so that porous member in contact with melt 2 can be prevented from erosion loss and melt 2 can be kept clean.

Also, a material which hardly gets wet with melts must be used for the partitioning member so that only gases can pass through the partitioning member but any melt can not pass through the partitioning member. Furthermore, it is preferable that a porosity of the partitioning member is not more than 40%.

Furthermore, in order to prevent a melt from entering the vacuum system even if a melt goes into the immersed porous tube, it is preferable to allocate a filter with small pressure loss in an upper section of the immersed porous tube to solidify the invading melt for trapping it.

The following is a description of a case in which the present invention is applied to the removal or recovery of gas-forming ingredients from a melt.

(1) First, the present invention can be applied to decarburization, denitrogenatlon, and dehydrogenation processes for removing carbon, nitrogen, or hydrogen from molten iron.

When this method is applied to remove carbon from molten iron, the main component of said partitioning member should be $Al_2O_3$ or MgO, and such a material as $Fe_2O_3$, $Fe_3O_4$, MnO, and $SiO_2$ etc. should be mixed in as main oxidizing agents for carbon in the molten iron. But if a compounding ratio of the main oxidizing agent is too high, a melting point of the partitioning member goes down, or the mechanical strength thereof becomes lower, and if carbon content in the molten iron is too low, oxygen content in the molten iron goes up, so that a compounding ratio of the main oxidizing agent must be decided according to the purpose and by referring to the phase diagram already established.

On the other hand, if this method is applied to removal of nitrogen in molten iron, a stable oxide such as CaO, $Al_2O_3$, or MgO should be used as said partitioning member.

Also, if this invention is applied to simultaneous removal of carbon and nitrogen in molten iron, the compounding ratio of the oxidizing agent should be changed according to target contents of carbon and nitrogen in the molten iron.

(2) The invention can be also applied to a deoxygenation process for removing oxygen from molten copper.

(3) Further, the invention can be applied to a dehydrogenation process for removing hydrogen from molten aluminum.

(4) Furthermore, the invention can be applied to decarburizatlon, and dehydrogenation of molten silicon.

(5) According to the present invention, zinc can be recovered from molten lead.

(6) The invention can be also applied to a desulfurization/deoxygenation process for removing sulfur and oxygen from molten copper matte.

(7) Further, the invention can be applied to the recovery of valuable metals (As, Sb, Bi, Se, Te, Pb, Cd, etc.) from molten copper matte or nickel matte.

(8) Furthermore, the invention can be applied to the recovery of valuable metals (As, Sb, Bi, Se, Te, Pb, Cd, Zn, etc.) from slag.

Detailed description is made below for embodiments of this invention.

Figure 2:
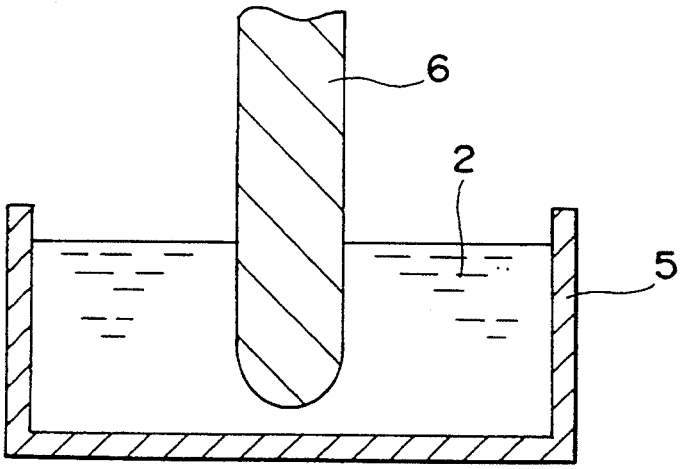
FIG. 2 is a schematic cross-sectional view showing a first embodiment of the invention.

FIG. 2 is a schematic cross-sectional view showing a vacuum-suction degassing apparatus according to an embodiment of the present invention. Melt 2 is stored in vessel 5, and a lower half portion of porous member 6 is immersed in this molten material 2. Porous member 6 has a form of rod, and is made of a porous material having pores which is permeable to gases and impermeable to melts, such as molten metal, molten slag, and molten matte. Therefore, melt 2 do not pass through.

Vessel 5 is placed in a decompression container (not shown), and inside of the decompression container is evacuated by the vacuum pump to maintain the inside in vacuum or under reduced pressure.

In the vacuum-suction degassing apparatus thus constructed, although melt 2 does not permeate through porous member 6, but as gases contained in pores of porous member 6 are released to inside of the decompression container, inside of pores of porous member 6 are evacuated or depressurized. Therefore, gases in melt 2 or gases produced by reactions between components of the porous member 6 and the melt 2 pass through the pores of porous member 6, and are released into vacuum or reduced pressure atmosphere in the decompression container. And, the gases are sucked by the vacuum pump and removed from inside of the decompression container.

Figure 3:
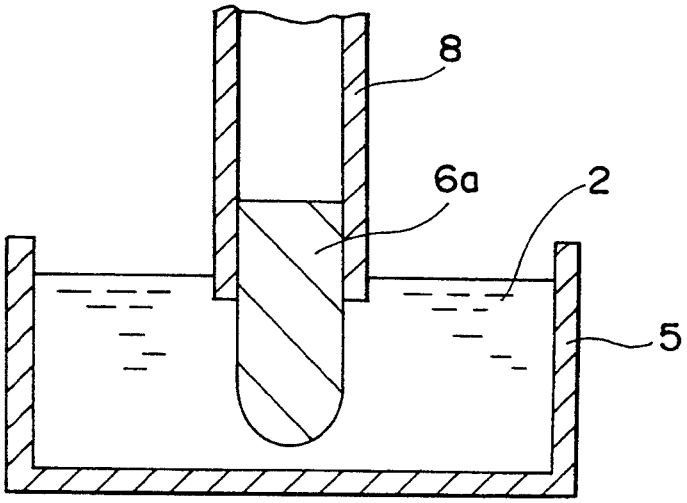
FIG. 3 is a schematic cross-sectional view showing second embodiment of the invention.

FIG. 3 is a schematic cross-sectional view showing a vacuum suction degassing apparatus according to an embodiment of the second invention in this application.

Melt 2 is stored in vessel 5. Porous member 6*a* has a form of rod, and is fitted into the lower portion of cylindrical non-porous member 8 in a liquid-sealing manner. Porous member 6*a* is made of a porous material having pores which gases can permeate through but melt 2, such as molten metal, molten slag, or molten matte can not enter and permeate through. Also, non-porous member 8 is made of a non-porous material which gases can not permeate through, and is linked to a vacuum pump (not shown).

In the vacuum suction degassing apparatus having the configuration as described above, when inside of non-porous member 8 is evacuated or depressurized, inside of pores of porous member 6 is evacuated or depressurized. Therefore, gas-forming components in molten 2 are exhausted through the pores of porous member 6*a* into inside of non-porous member 8. And, the gas-forming components are sucked by the vacuum pump and recovered or exhausted.

Also in this embodiment, porous member 6*a* has only to be immersed in molten material 2, and even if depth of a melt bath is small, degasification of molten materials can be performed.

What is claimed is;

1. A vacuum-suction degassing apparatus comprising:

a vessel containing a melt;

a porous rod made of a ceramic porous material permeable to gas and impermeable to melts, said porous material having a chemical composition which chemically reacts with an impurity in said melt to yield a product gas, a portion of said porous rod being immersed in said melt in the vessel so as to define a chemical reaction interface with said melt; and sucking means for sucking said product gas through said porous rod, in a manner such that a portion of said porous rod which protrudes above the surface of said melt is kept at a vacuum or at a reduced pressure to create a pressure difference for sucking said product gas, wherein said suction created by said pressure difference causes said gas product to permeate said porous rod in an axial direction thereof.

2. A vacuum-suction degassing apparatus comprising:

a vessel containing a melt;

a non-porous pipe;

a porous rod made of a ceramic porous material permeable to gas and impermeable to melts, said porous material having a chemical composition which chemically reacts with an impurity in said melt to yield a product gas, and said porous rod being fitted into a lower portion of said non-porous pipe and immersed in said melt in said vessel so as to define a chemical reaction interface with said melt; and sucking means for sucking said product gas through said porous rod, in a manner such that the inside of said non-porous pipe is kept at a vacuum or at a reduced pressure to create a pressure difference for sucking said product gas, wherein said suction created by said pressure difference causes said gas product to permeate said porous rod in an axial direction thereof.

3. The vacuum-suction degassing apparatus according to claim 1, comprising:

heating means for electrically heating said porous rod.

4. The vacuum-suction degassing apparatus according to claim 2, comprising:

heating means for electrically heating said porous rod.

5. The vacuum-suction degassing apparatus according to claim 1, wherein said porous material is a material selected from the group consisting of:

$Al_2O_3$, MgO, CaO, $SiO_2$, $Fe_2O_3$, $Fe_3O_4$, $Cr_2O_3$, BN, $Si_3N_4$, SiC and C.

6. A vacuum-suction degassing apparatus according to claim 1, wherein said porous material is an oxide having the formula $M_XO_Y$ and the impurity is carbon, said impurity being removed according to the formula:

$$y\underline{C}+M_XO_Y\,(\text{solid})=x\underline{M}+yCO.$$

7. The vacuum-suction degassing apparatus according to claim 1, wherein said porous rod contains carbon, wherein said impurity is oxygen, and said impurity is removed according to the formula:

$$\underline{O}+C\ (\text{solid})=CO.$$

8. The vacuum-suction degassing apparatus according to claim 2, wherein said porous material is a material selected from the group consisting of:

$Al_2O_3$, MgO, CaO, $SiO_2$, $Fe_2O_3$, $Fe_3O_4$, $Cr_2O_3$, BN, $Si_3N_4$, SiC and C.

9. A vacuum-suction degassing apparatus according to claim 2, wherein said porous material is an oxide having the formula $M_XO_Y$ and the impurity is carbon, said impurity being removed according to the formula:

$$y\underline{C}+M_XO_Y\,(\text{solid})=x\underline{M}+yCO.$$

10. The vacuum-suction degassing apparatus according to claim 2, wherein said porous rod contains carbon, wherein said impurity is oxygen, and said impurity is removed according to the formula:

$$\underline{O}+C\ (\text{solid})=CO.$$

* * * * *